US008070328B1

(12) United States Patent
Knoble et al.

(10) Patent No.: US 8,070,328 B1
(45) Date of Patent: Dec. 6, 2011

(54) LED DOWNLIGHT

(75) Inventors: David W. Knoble, Tupelo, MS (US); Khosrow Jamasbi, Belden, MS (US); Brian McMillin, Tupelo, MS (US)

(73) Assignee: Koninkliljke Philips Electronics N.V., Eindhoven (NL)

( * ) Notice: Subject to any disclaimer, the term of this patent is extended or adjusted under 35 U.S.C. 154(b) by 342 days.

(21) Appl. No.: 12/352,750

(22) Filed: Jan. 13, 2009

(51) Int. Cl.
*F21V 3/00* (2006.01)
*F21V 8/00* (2006.01)

(52) U.S. Cl. ..... 362/311.02; 362/245; 362/247; 362/249.02; 362/294; 362/343; 362/345; 362/364

(58) Field of Classification Search ..... 362/245–247, 362/249.02, 294, 308, 311.02, 343, 345, 362/364, 373
See application file for complete search history.

(56) References Cited

U.S. PATENT DOCUMENTS

| | | | |
|---|---|---|---|
| 4,081,023 | A | 3/1978 | Edelstein |
| 4,321,656 | A | 3/1982 | Gruver |
| 4,503,360 | A | 3/1985 | Bedel |
| 4,509,106 | A | 4/1985 | Mayer |
| 4,729,076 | A | 3/1988 | Masami |
| 4,734,835 | A | 3/1988 | Vines |
| 4,871,944 | A | 10/1989 | Skwirut |
| 4,941,072 | A | 7/1990 | Yasumoto |
| 4,954,822 | A | 9/1990 | Borenstein |
| 5,010,452 | A | 4/1991 | Krebser |
| 5,136,287 | A | 8/1992 | Borenstein |
| 5,138,541 | A | 8/1992 | Kano |
| 5,351,172 | A | 9/1994 | Attree |
| 5,537,301 | A | 7/1996 | Martich |
| 5,548,499 | A | 8/1996 | Zadeh |
| 5,636,057 | A | 6/1997 | Dick |
| 5,688,042 | A | 11/1997 | Madadi |
| 5,785,418 | A | 7/1998 | Hochstein |
| 5,924,788 | A | 7/1999 | Parkyn |
| 5,980,071 | A | 11/1999 | Hsieh |
| 5,993,027 | A | 11/1999 | Yamamoto |
| 6,045,240 | A | 4/2000 | Hochstein |
| 6,050,707 | A | 4/2000 | Kondo |
| 6,068,384 | A | 5/2000 | Tyson |
| 6,154,362 | A | 11/2000 | Takahashi |
| 6,183,114 | B1 | 2/2001 | Cook |
| 6,193,603 | B1 | 2/2001 | Tai |
| 6,350,043 | B1 | 2/2002 | Gloisten |
| 6,350,046 | B1 | 2/2002 | Lau |
| 6,367,949 | B1 | 4/2002 | Pederson |
| 6,379,024 | B1 | 4/2002 | Kogure |
| 6,402,346 | B1 | 6/2002 | Liao |

(Continued)

FOREIGN PATENT DOCUMENTS

| | | | |
|---|---|---|---|
| JP | 11154766 | A1 | 6/1999 |

(Continued)

*Primary Examiner* — Stephen F Husar

(57) ABSTRACT

An LED downlight fixture comprises an array of LEDs in thermal connectivity with a heatsink, the array of LEDs positioned adjacent a first aperture of a multi-piece reflector assembly, the multi-piece reflector assembly including a first reflector having the first aperture disposed in an upper portion of the first reflector and an opposed larger second aperture in a lower portion of the first reflector, a second reflector having a first aperture positioned adjacent the second aperture of the first reflector and a second aperture opposite the first aperture of the second reflector and defining a light exit passageway, a diffuser positioned proximal to and extending across the second aperture of the first reflector and the first aperture of the second reflector.

21 Claims, 7 Drawing Sheets

U.S. PATENT DOCUMENTS

| | | | | |
|---|---|---|---|---|
| 6,502,962 | B1 | 1/2003 | Menke | |
| 6,560,038 | B1 | 5/2003 | Parkyn | |
| 6,573,536 | B1 | 6/2003 | Dry | |
| 6,632,006 | B1 | 10/2003 | Rippel | |
| 6,678,168 | B2 | 1/2004 | Kenny | |
| 6,705,751 | B1 | 3/2004 | Liu | |
| 6,815,724 | B2 | 11/2004 | Dry | |
| 6,860,628 | B2 | 3/2005 | Robertson | |
| 6,871,983 | B2 | 3/2005 | Jacob | |
| 6,905,227 | B2 | 6/2005 | Wu | |
| 6,955,440 | B2 | 10/2005 | Niskanen | |
| 6,965,715 | B2 | 11/2005 | Lei | |
| 6,974,233 | B1 | 12/2005 | Aubrey | |
| 6,986,593 | B2 | 1/2006 | Rhoads | |
| 6,994,452 | B2 | 2/2006 | Rozenberg | |
| 6,997,583 | B2 | 2/2006 | Broelemann | |
| 7,014,341 | B2 | 3/2006 | King | |
| 7,098,486 | B2 | 8/2006 | Chen | |
| 7,104,672 | B2 | 9/2006 | Zhang | |
| 7,140,753 | B2 | 11/2006 | Wang | |
| 7,307,546 | B1 | 12/2007 | Partap | |
| 7,311,423 | B2 | 12/2007 | Frecska | |
| 7,322,718 | B2 | 1/2008 | Setomoto | |
| 7,329,031 | B2 | 2/2008 | Liaw | |
| 7,348,723 | B2 | 3/2008 | Yamaguchi | |
| 7,387,405 | B2 | 6/2008 | Ducharme | |
| 7,440,280 | B2 | 10/2008 | Shuy | |
| 7,524,089 | B2 | 4/2009 | Park | |
| 7,731,388 | B2 * | 6/2010 | Hoelen et al. | 362/245 |
| 2002/0122309 | A1 | 9/2002 | Abdelhafez | |
| 2004/0120152 | A1 | 6/2004 | Bolta | |
| 2004/0141326 | A1 | 7/2004 | Dry | |
| 2005/0030761 | A1 | 2/2005 | Burgess | |
| 2005/0036322 | A1 | 2/2005 | Veffer | |
| 2005/0122229 | A1 | 6/2005 | Stevenson | |
| 2005/0168986 | A1 * | 8/2005 | Wegner | 362/241 |
| 2005/0190567 | A1 | 9/2005 | Childers | |
| 2005/0207168 | A1 | 9/2005 | Chubert | |
| 2005/0276053 | A1 | 12/2005 | Nortrup | |
| 2006/0109661 | A1 | 5/2006 | Coushaine | |
| 2006/0164843 | A1 | 7/2006 | Adachi | |
| 2006/0193139 | A1 | 8/2006 | Sun | |
| 2006/0209545 | A1 | 9/2006 | Yu | |
| 2006/0215408 | A1 | 9/2006 | Lee | |
| 2006/0262545 | A1 | 11/2006 | Piepgras | |
| 2007/0030686 | A1 | 2/2007 | Haugaard | |
| 2007/0211470 | A1 | 9/2007 | Huang | |
| 2007/0230172 | A1 | 10/2007 | Wang | |
| 2007/0230183 | A1 | 10/2007 | Shuy | |
| 2007/0230184 | A1 | 10/2007 | Shuy | |
| 2007/0247853 | A1 | 10/2007 | Dorogi | |
| 2007/0279909 | A1 | 12/2007 | Li | |
| 2008/0007955 | A1 | 1/2008 | Li | |
| 2008/0043472 | A1 | 2/2008 | Wang | |
| 2008/0080188 | A1 | 4/2008 | Wang | |
| 2008/0084701 | A1 | 4/2008 | Van De Ven | |
| 2008/0112168 | A1 * | 5/2008 | Pickard et al. | 362/247 |
| 2008/0158887 | A1 | 7/2008 | Zhu | |
| 2008/0165535 | A1 | 7/2008 | Mazzochette | |
| 2008/0204888 | A1 | 8/2008 | Kan | |
| 2008/0205062 | A1 | 8/2008 | Dahm | |
| 2008/0212333 | A1 | 9/2008 | Chen | |
| 2008/0304269 | A1 | 12/2008 | Pickard | |
| 2009/0080189 | A1 | 3/2009 | Wegner | |
| 2009/0086476 | A1 | 4/2009 | Tickner | |
| 2009/0086481 | A1 | 4/2009 | Wegner | |

FOREIGN PATENT DOCUMENTS

| | | | |
|---|---|---|---|
| JP | 2006172895 | A1 | 6/2006 |
| JP | 2008171584 | A1 | 7/2008 |

* cited by examiner

LED DOWNLIGHT

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present invention pertains to downlight luminaries. More particularly, the present invention pertains to downlight luminaries having an LED lighting array with a diffuser positioned within a reflector assembly.

2. Description of the Related Art

There are various types of downlight fixtures in the marketplace. Downlights are very popular for multiple reasons including aesthetics, options available for lighting arrangements, as well as amount of light output. Additionally, for example, due to positioning of the lamp within the downlight fixture, cut-off characteristics can be managed. Many prior art downlights use incandescent lamps. However, incandescent lamps or bulbs are less efficient than light emitting diodes (LEDs). Typically, the efficiency is on the order of 50 or more lumens per watt. Fluorescent lamps are also utilized in downlight fixtures. LEDs are more efficient than fluorescent lights and have a longer life than HID, fluorescent or incandescent lights. For example, LEDs may have a life of 50,000 hours before decrease to 70% light output. Additionally, LEDs are dimmable without changing color or efficacy, contrary to incandescent lamps. Whereas fluorescent lamps reduce efficacy as they dim, an LED is dimmable to 0%.

The previously mentioned prior art lamp systems typically use 110 or 220 Volt power supplies. To the contrary, LED lamps typically draw on low voltage low energy and therefore pose little to no safety or fire hazard according to UL standards. Due to the low voltage operation, it may be more economical to operate LED lamps from batteries than fluorescent or HID lamps.

Accordingly, it would be desirable to form a downlight having the advantages of an LED lamping system and which also has the advantages of a clear cutoff with minimal glare.

Given the foregoing deficiencies, it would be appreciated to use a luminaire with the advantages of LED which also has the advantage of downlighting.

SUMMARY OF THE INVENTION

An LED downlight fixture comprises an array of LEDs in thermal connectivity with a heatsink, the array of LEDs positioned adjacent a first aperture of a multi-piece reflector assembly, the multi-piece reflector assembly including a first reflector having the first aperture disposed in an upper portion of the first reflector and an opposed larger second aperture in a lower portion of the first reflector, a second reflector having a first aperture positioned adjacent the second aperture of the first reflector and a second aperture opposite the first aperture of the second reflector and defining a light exit passageway, a diffuser positioned proximal to and extending across the second aperture of the first reflector and the first aperture of the second reflector. The heatsink has a plurality of fins positioned external to the reflector assembly. Each LED of the array of LEDs is surrounded by an LED reflector. The LED downlight fixture wherein the second reflector is attached to the first reflector. The diffuser is engaging the first reflector and extends across the second aperture of the first reflector. The LED downlight fixture wherein the second reflector is attached to the diffuser. The LED downlight fixture wherein the diffuser is attached to the second reflector and extends across the first aperture of the second reflector. The LED downlight fixture wherein a support frame is attached to the heatsink and the exterior of the second reflector. The LED downlight fixture wherein the first aperture of the first reflector, the second aperture of the first reflector, the diffuser, and the first and second aperture of said second reflector are all vertically aligned.

A LED downlight fixture comprises an LED array having a plurality LEDs in thermal communication with a heat sink, a reflector assembly having a first reflector portion and a second reflector portion, the reflector assembly having a first reflector including an upper aperture and a lower aperture, a second reflector including a second upper aperture and a second lower aperture, the second upper aperture of the second reflector aligned with the lower aperture of the first reflector, a diffuser captured between the first reflector and the second reflector and substantially aligned with the lower aperture of the first reflector and the upper aperture of the second reflector, the LEDs aligned with the upper aperture of the first reflector and the heat sink extending radially above an outer surface of the first reflector. The LED downlight fixture further comprising a non-conductive lens between said LED array and the upper aperture of the first reflector. The LED downlight fixture further comprising a mounting ring positioned on one of the first reflector and the second reflector. The diffuser is positioned in the mounting ring. The LED downlight fixture, the first reflector and the second reflector defining a light exit passageway. The diffuser being positioned in the light exit passageway.

A LED downlight fixture comprises an array of LEDs defined by a plurality of LEDs, the LEDs in thermal communication with a heat sink, a reflector assembly having a first reflector portion and a second reflector portion, the reflector assembly defining a light exit passageway, the first reflector having a first upper aperture and a second lower aperture, the second reflector having a first upper aperture and a second lower aperture, the array of LEDs positioned over the first upper aperture of the first reflector, a diffuser connected to one of the first reflector and the second reflector and disposed within the reflector assembly and in alignment with the second lower aperture of the upper reflector and the first upper aperture of the second reflector, the heat sink having a plurality of radially extending fins, positioned above the reflector assembly. The LED downlight fixture, the LED array further comprising a circuit board. The LED downlight fixture further comprising a lens disposed over between the LED array and the reflector assembly inhibit contact between the LED array and the reflector assembly.

An LED downlight fixture comprises an LED array formed of a plurality of LEDs, the LED array positioned in thermal communication with a heat sink, a reflector having an upper opening and a lower opening, the LED array disposed adjacent the upper opening, a diffuser positioned a preselected spaced distance from the LED array, the diffuser positioned one of above a lowermost edge reflector or beneath the lowermost edge of the reflector, and, a lens disposed between the LED array and an uppermost edge of the reflector. The diffuser connected to a spacer element, the spacer element connected to the reflector. The diffuser affixed to an interior of the reflector.

An LED downlight fixture, comprises an LED array formed of a plurality of LEDs, the LED array positioned in thermal communication with a heat sink, a reflector having an upper opening and a lower opening, the LED array disposed adjacent the upper opening, a diffuser positioned a preselected spaced distance from the LED array, the diffuser positioned one of above a lowermost edge reflector or beneath the lowermost edge of the reflector, and, a lens disposed between the LED array and an uppermost edge of the reflector. The diffuser is connected to a spacer element, the spacer element connected to the reflector. Alternatively, the diffuser may be affixed to an interior of the reflector.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
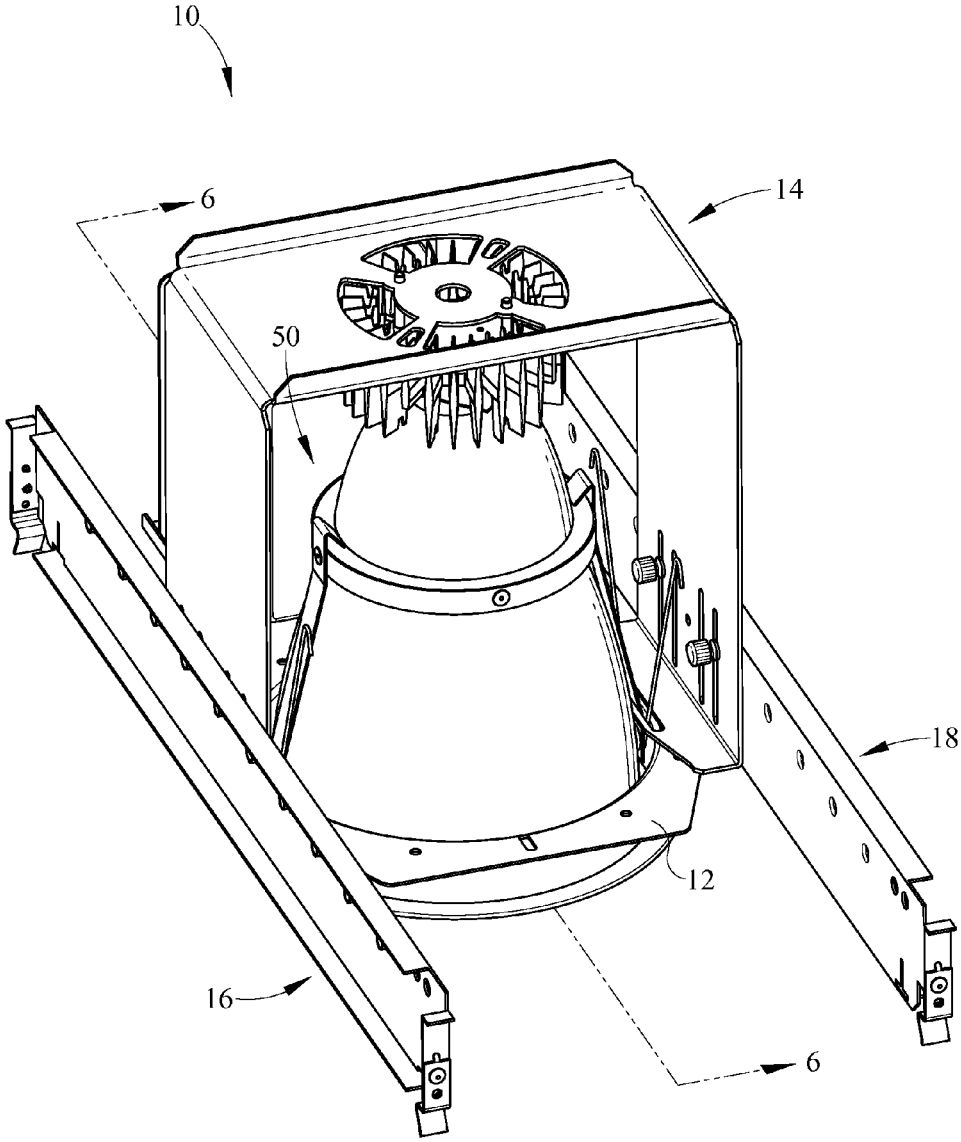
FIG. 1 is a perspective view of a downlight fixture frame-in kit.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring now in detail to the drawings, wherein like numerals indicate like elements throughout the several views, there are shown in FIGS. 1-7 various aspects of a LED downlight fixture. The LED downlight includes a reflector assembly with a diffuser positioned therein. The LED and diffuser positioned within the reflector assembly provide ample light cut-off, reduced glare and increased light efficiency.

Referring initially to FIG. 1, the fixture frame-in kit 10 is shown in perspective view. The frame-in kit 10 comprises a fixture frame pan 12, a substantially U-shaped frame members 14 extending upwardly from the frame pan 12 and over a reflector assembly 50. However, the U-shaped member may be formed of other shapes and therefore should not be considered limiting. The frame-in kit 10 also comprises a first mounting rail 16 and a second mounting rail 18.

The frame-in kit 10 is depicted as a non-insulated ceiling (Non-IC) type fixture. However, one skilled in the art should understand that the fixture may alternatively be an insulated ceiling (IC) type of fixture, which generally provides a barrier between insulation and the lighting reflector housing and components. The IC type fixture further provides a volume of air within an outer housing defining the volume for the dissipation of heat generated by the fixture. Further, the LED downlight assembly described herein may be utilized with both new construction and remodeler-type fixture assemblies.

The first and second mounting rails 16, 18 allow attachment of the fixture frame-in kit 10 between ceiling support structures (not shown). The support structures may include joists or inverted T-grid members or inverted slotted members. The mounting rails 16, 18 may be connected directly or indirectly to the ceiling support structures.

Figure 2:
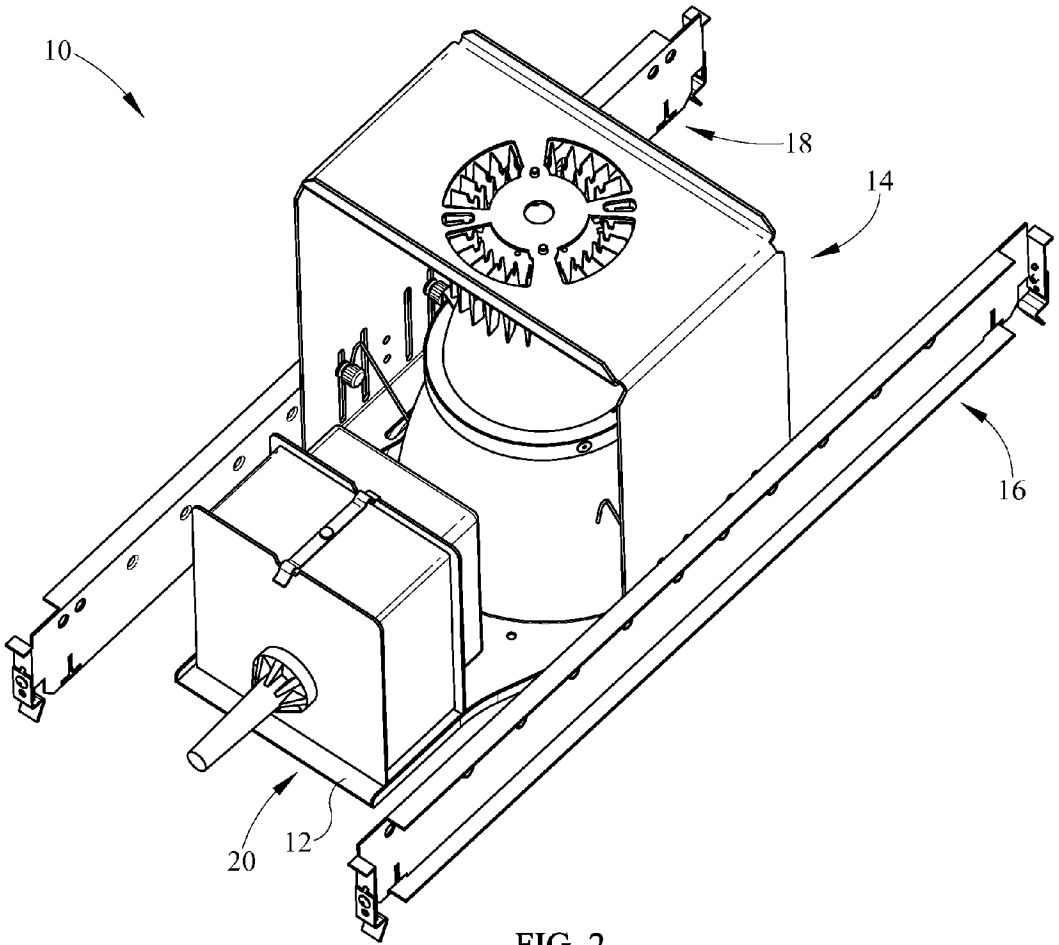
FIG. 2 is a top perspective view of the downlight fixture frame-in kit of FIG. 1 rotated to depict the junction box.
Figure 3:
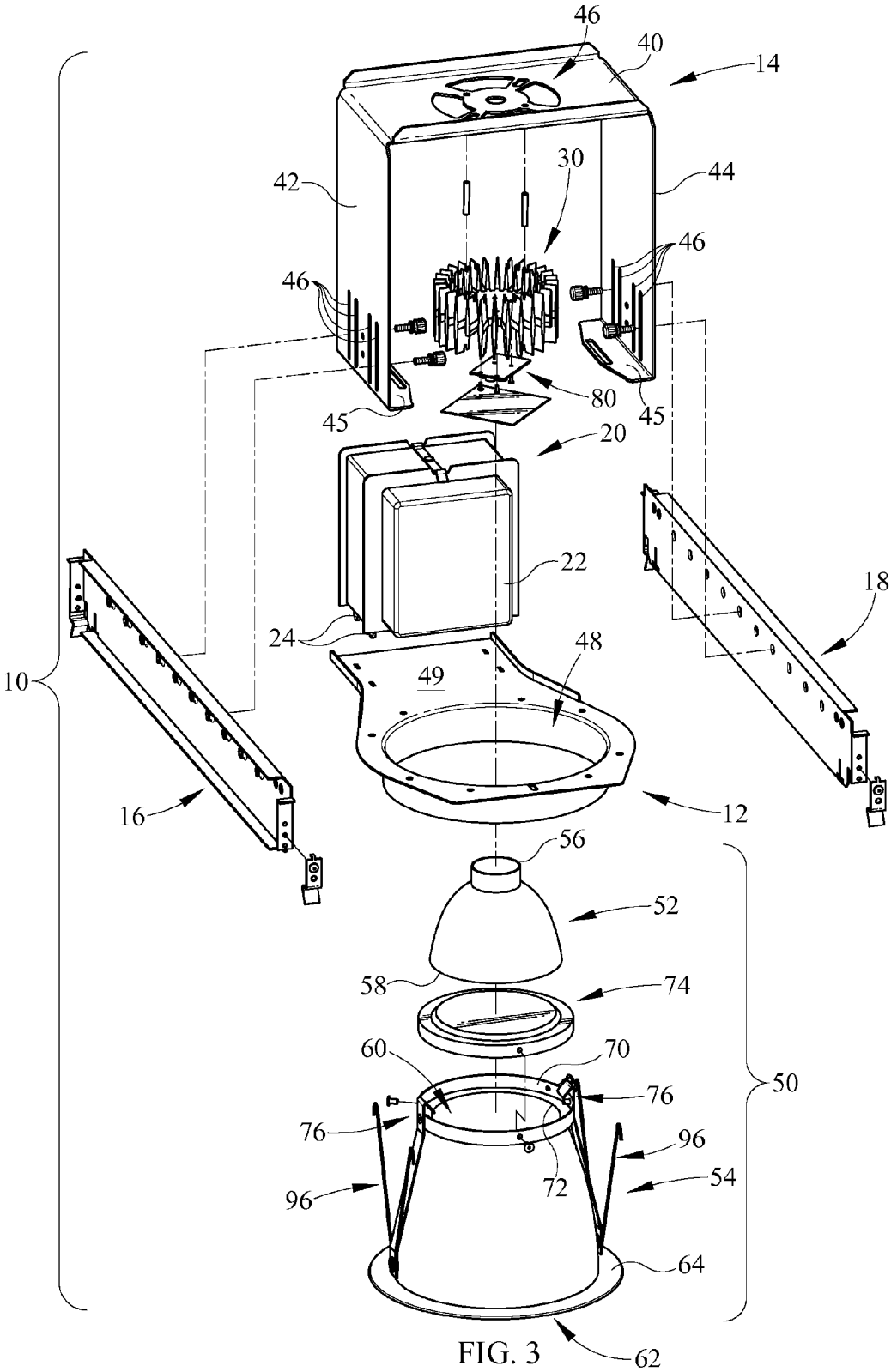
FIG. 3 is an exploded perspective view of the downlight fixture frame-in kit.

Referring now to FIG. 2, the fixture frame-in kit 10 is rotated to depict a junction box 20 mounted on the pan 12. The junction box 20 houses wiring connections between a power supply to wiring extending to an LED array 80 (FIG. 3). The junction box 20 comprises at least one door. The instant embodiment includes first and second doors but this embodiment is merely exemplary. Additionally, the junction box 20 is positioned in a vertical orientation. On one surface of the junction box 20 is a ballast 22 which provides proper voltage to the LED array 80. Alternatively, the junction box 20 may house the ballast 22 if desirable.

Referring now to FIG. 3, an exploded perspective view of the fixture frame-in kit 10 is depicted. Near the upper end of the kit 10 is a fixture frame member 14. The frame 14 has a first vertically extending leg 42 and a second vertically extending leg 44. A cross member 40 extends between the first and second legs 42, 44. The cross member 40 has a plurality of apertures 46 allowing flow through of radiating heat from the heat sink 30 below. The legs 42, 44 include at least one adjustment slot 46 allowing vertical adjustment of the fixture frame 14 relative to the mounting rails 16, 18 and ceiling support structures. Extending from the bottom of the legs 42, 44 are first and second landings 45. Each landing 45 has an aperture through which a torsional retaining spring 96 may pass.

Connected to the fixture frame member 14 is the pan 12 wherein a reflector assembly 50 is mounted. The pan 12 includes a generally flat plate or structure with a central aperture 48 wherein the reflector assembly 50 is positioned. The pan 12 also includes a mounting surface 49 where a junction box 20 is disposed. The junction box 20 is substantially vertically oriented and has at least one access door 20. Positioned on the junction box 20 is a ballast 22 as previously described. According to the exemplary embodiment, the junction box 20 has a plurality of feet 24 extending from a lower surface therefrom. The mounting area 49 has a plurality of matching apertures which align with the feet 24 of junction box 20. Once the feet 24 are positioned through the apertures 13 of the mounting area 49, the feet 24 may be bent to lock the junction box 20 in position on the pan 12. This is however merely one exemplary embodiment and alternative embodiments are within the scope of the instant disclosure. For example, the feet could extend upwardly from the pan 12 through apertures in the junction box 20 and be bent therein to connect the pan 12 and junction box 20.

The reflector assembly 50 includes a first upper reflector 52 and a second lower reflector 54. The upper reflector 52 is generally dome shaped including an upper aperture 56 wherein a LED array 80 is positioned. The first reflector 52 also includes a lower aperture 58 defining a lower edge of the reflector 52. The lower aperture 58 is larger than the upper aperture 56 and substantially aligned therewith so that a light exit passageway 90 (FIG. 6) is partially defined.

According to one embodiment, the first reflector 52 is formed of specular reflective aluminum capable of conducting heat and supporting a lamp. Alternatively, other materials may be utilized having diffuse or specular reflective characteristics. The second reflector 54 may be formed of the same or similar materials as the first reflector 52. The exemplary reflectors 52, 54 may have semi-diffuse reflective surfaces although alternative finishes are contemplated and within the spirit and scope of these teachings.

The second reflector 54 is generally frusto-conical in shape and has an upper aperture 60, a lower aperture 62 and a sidewall extending there between. The second reflector 54 may have a sidewall with some curvature or may be substantially straight between the upper aperture 60 and the lower aperture 62. The upper and lower apertures 60, 62 are aligned with the apertures of the first reflector 52 so as to define the light exit passageway 90 generally defined between the upper aperture 56 and lower aperture 62. Thus, when the LED array 80 is positioned above the first reflector 52, the LED light output shines downwardly and out of the reflector assembly 50 through the lower aperture 62. The lower edge of reflector 54 includes a trim ring or flange 64. The flange 64 covers any gaps in the between the ceiling and the fixture.

At the upper end of the second reflector 54 is a diffuser mounting ring 70. The ring 70 is substantially cylindrical with an open center. A shoulder 72 extends radially inwardly for positioning of a diffuser 74 within the light exit passageway 90. The exemplary diffuser 74 is a Meso-Optic diffuser from Ledalite in Vancouver, Canada. The mounting ring 70 has a substantially vertical sidewall extending upwardly from the shoulder 72, wherein the diffuser 74 is seated. The at least one retaining spring 76 is mounted on the periphery of the upper edge of the second reflector 54. The exemplary embodiment utilizes first and second retaining springs 76 to retain the diffuser 74 in position. The springs 76 are formed of elastic material, for example thin metal, wherein the springs 76 flex radially outwardly during installation of the diffuser 74 and may be flexed radially outwardly in order to remove the diffuser 74.

The mounting ring 70 is depicted on the second reflector 54, however the mounting ring 70 may alternatively be position on the first reflector at the lower aperture 58. Similarly, the diffuser 74 may be positioned within the first reflector 52 or within the second reflector 54. In any embodiment, the diffuser 74 is disposed in alignment with the exit passageway 90 (FIG. 6) so that light from the LED passes through the diffuser 74 while moving through the reflector assembly 50. In either embodiment, the diffuser 74 is positioned within the reflector assembly 50 for optimal cut-off and reduced glare. Additionally, the diffuser 74 may be easily replaced by replacement of either reflector 52, 54 depending on the assembly used.

Figure 4:
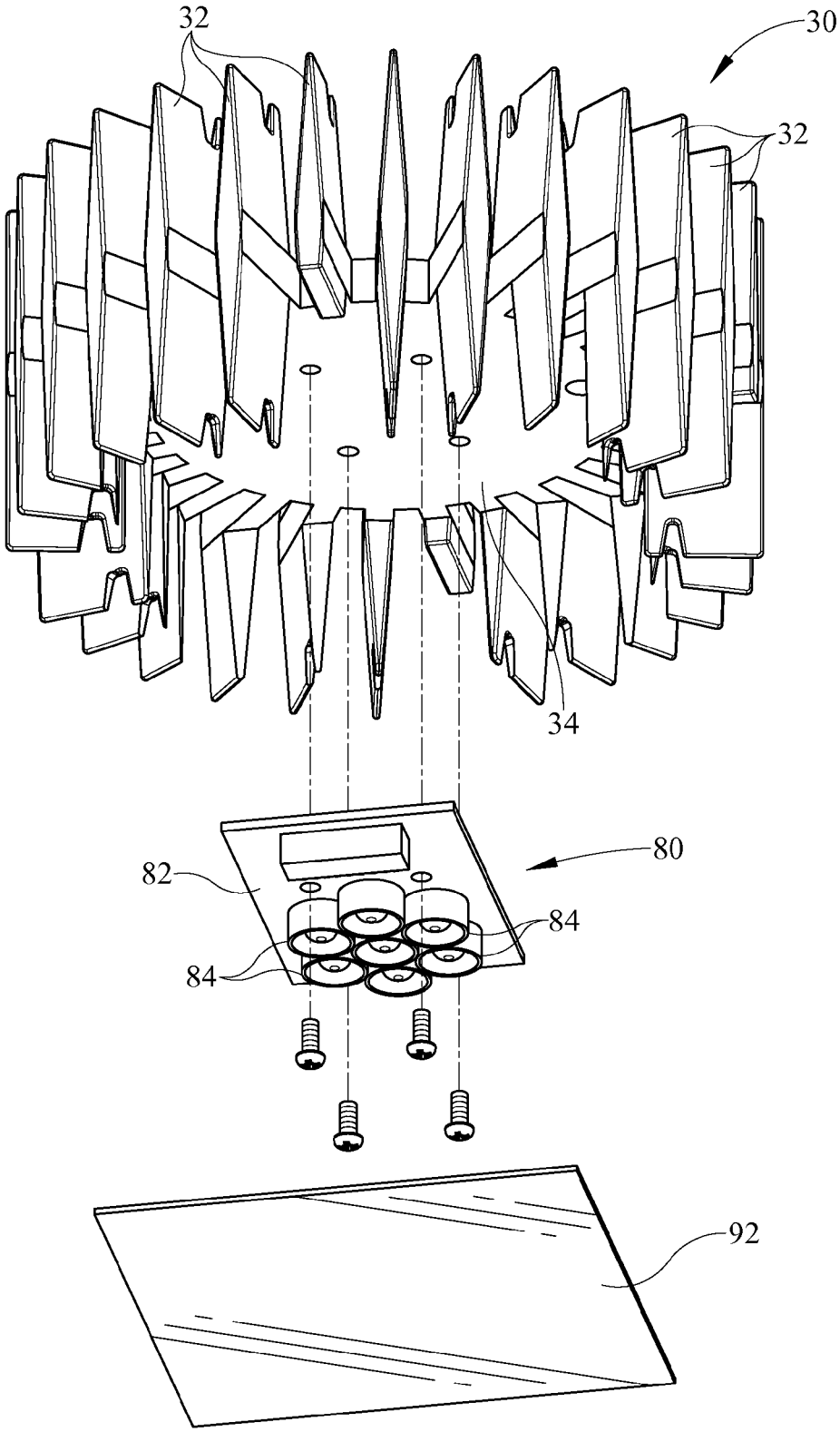
FIG. 4 is an exploded perspective view of the heatsink and LED array.

Referring now to FIG. 4, a perspective view of the heatsink 30 and LED array 80 is depicted. The heatsink 30 is positioned above the upper reflector 52 (FIG. 3). The positioning of the heatsink 30 allows maximum heat reduction and increased life for the LEDs 84. The heatsink 30 includes a substantially circular mounting plate 34 and a plurality of heatsink fins 32 extending from the mounting plate 34. The circular mounting plate is sized in general to be similar in size to the upper aperture 56 of the first reflector 52. The fins 32 depend from the mounting plate 34 about the periphery of the upper aperture 56 of the first reflector 52. The heatsink 30 may be formed of various materials which are heat conductive.

Fastened to the lower surface of the mounting plate 34 is an LED (light emitting diode) array 80. The exemplary array 80 is manufactured by Lamina Ceramics. The array 80 comprises a circuit board 82 to which a plurality of LEDs are in electrical communication for driving a light signal. The circuit board 82 may be a LP1040-C15-2000 circuit board although alternate types may be utilized and is metal clad for thermal transfer properties. The LEDs 84 may be Lamana TruColor SBX LEDs however alternate LEDs may be utilized. Each LED 84 is in electrical communication with the circuit board 82 which powers the LEDs 84. The array 80 includes seven LEDs 84 with reflectors surrounding each LED. The circuit board 82 comprises at least one fastener aperture which is aligned with at least one fastener aperture in the mounting plate 34. According to the exemplary embodiment, four screws may be utilized, however such construction should not be considered limiting. Once connected, the circuit board 82 is in thermal connectivity with the heat sink 30 so that heat created by the LEDs 84 is dissipated through the heatsink 30.

Beneath the LED array 80 is a lens 92 which protects the LEDs 84 from debris which may move upwardly though the reflector assembly 50 and contaminate the LEDs 84 of the circuit board 82. The lens 92 also inhibits metal-to-metal contact between the electrically "live" circuit board 82 and the upper edge 50 of the reflector 52 (FIG. 3). The metal-to-circuit contact would cause a disruption in operation, and possible damage to the LED circuitry. The lens 92 may be glass, acrylic, or other material having heat capacity commensurate with the LEDs 84 as well as desirable optical characteristics.

Figure 5:
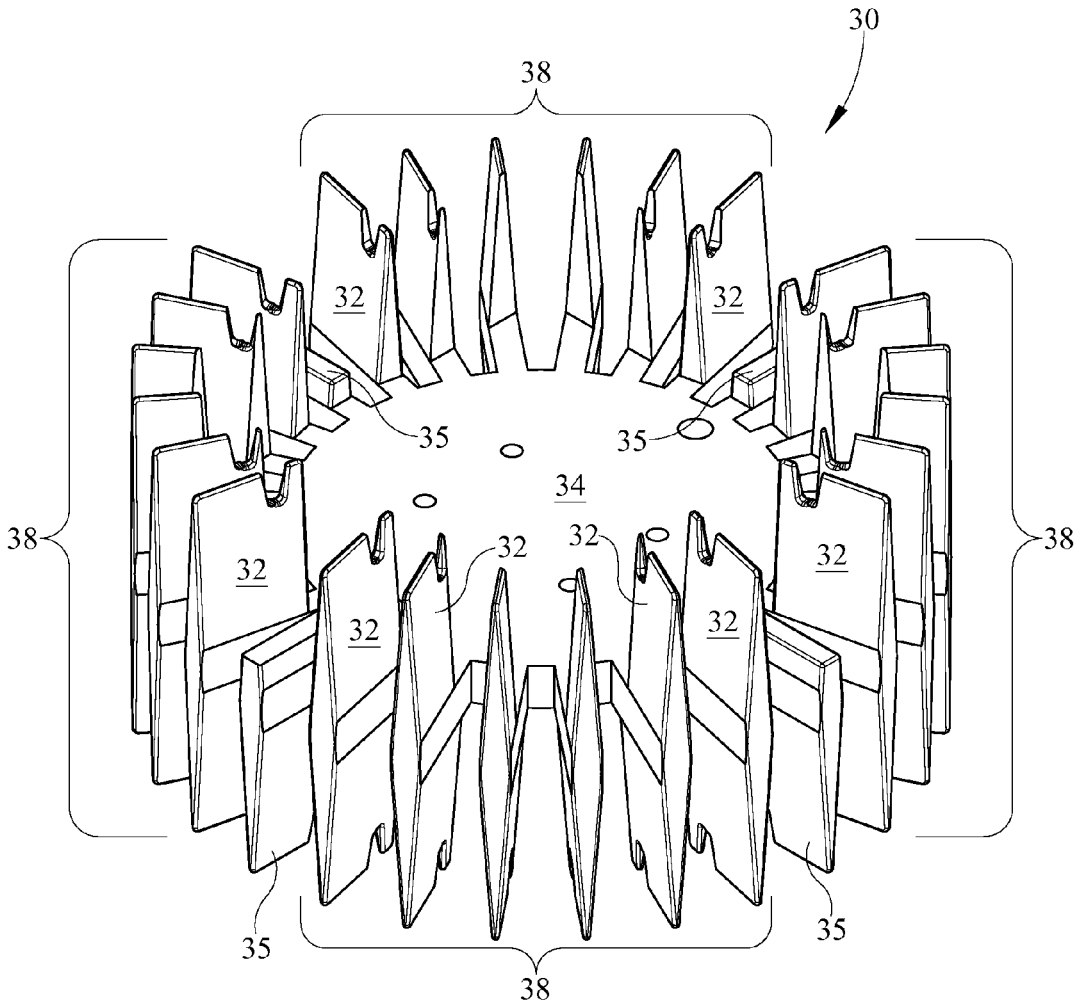
FIG. 5 is a perspective view of the heatsink.

Referring now to FIG. 5, the heatsink 30 is depicted in perspective view having a plurality of fins 32. The fins 32 define fin groups 38. According to the exemplary embodiment, the fins 32 are arranged in groups of six fins 32. Each group 38 of six fins 32 is separated by a half-fin 35. The half-fins 35 provide spacing between full-sized fins for positioning of corners of the lens 92. Therefore, the half-fins do not have great thermal significance, but instead are mechanically significant.

Figure 6:
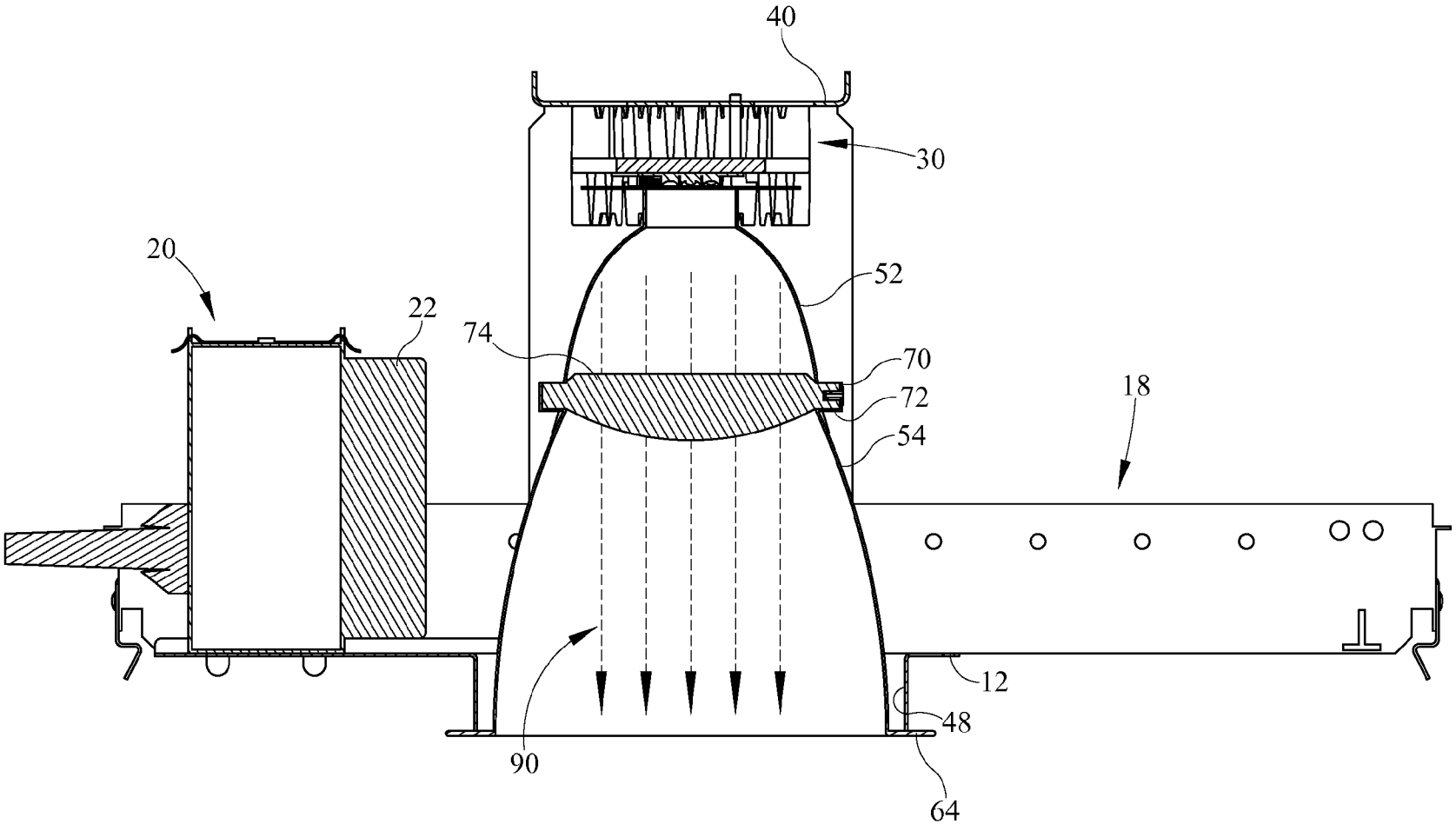
FIG. 6 is a side-sectional view of the downlight fixture frame-in kit.

Referring now to FIG. 6, a cross-sectional view of the fixture frame-in kit 10 is depicted. The diffuser 74 is disposed in between the upper and lower reflectors 52, 54. The mounting ring 70 provides a position for the diffuser 74 to be seated. A rivet is shown extending through the mounting ring sidewall 70 and into the diffuse cartridge. It should be understood by one skilled in the art that the modularity of the mounting ring 70 being connected to the lower reflector 54 allow easy replacement for the diffuser, for example if it is damaged during installation or during shipping, by replacement of the lower reflector 54. Alternatively, the mounting ring may be connected to the upper reflector 54 near the lower aperture thereof. In a further alternative, the diffuser 74 may be captured between the upper and lower reflectors when the upper and lower reflectors 52, 54 are connected. In yet a further alternative, the diffuser may be positioned within a one-piece reflector.

The diffuser 74 allows a very smooth light output, allowing a user to look directly upwardly into the downlight 10 without causing great pain to the user's eyes. This elimination of bright spots allows controlling of the maximum brightness or luminance. Additionally, the effective light source is moved from the location of the LEDs 84 to the diffuser 74 within the reflector assembly 50. This helps optical control such as cut-off characteristics.

Figure 7:
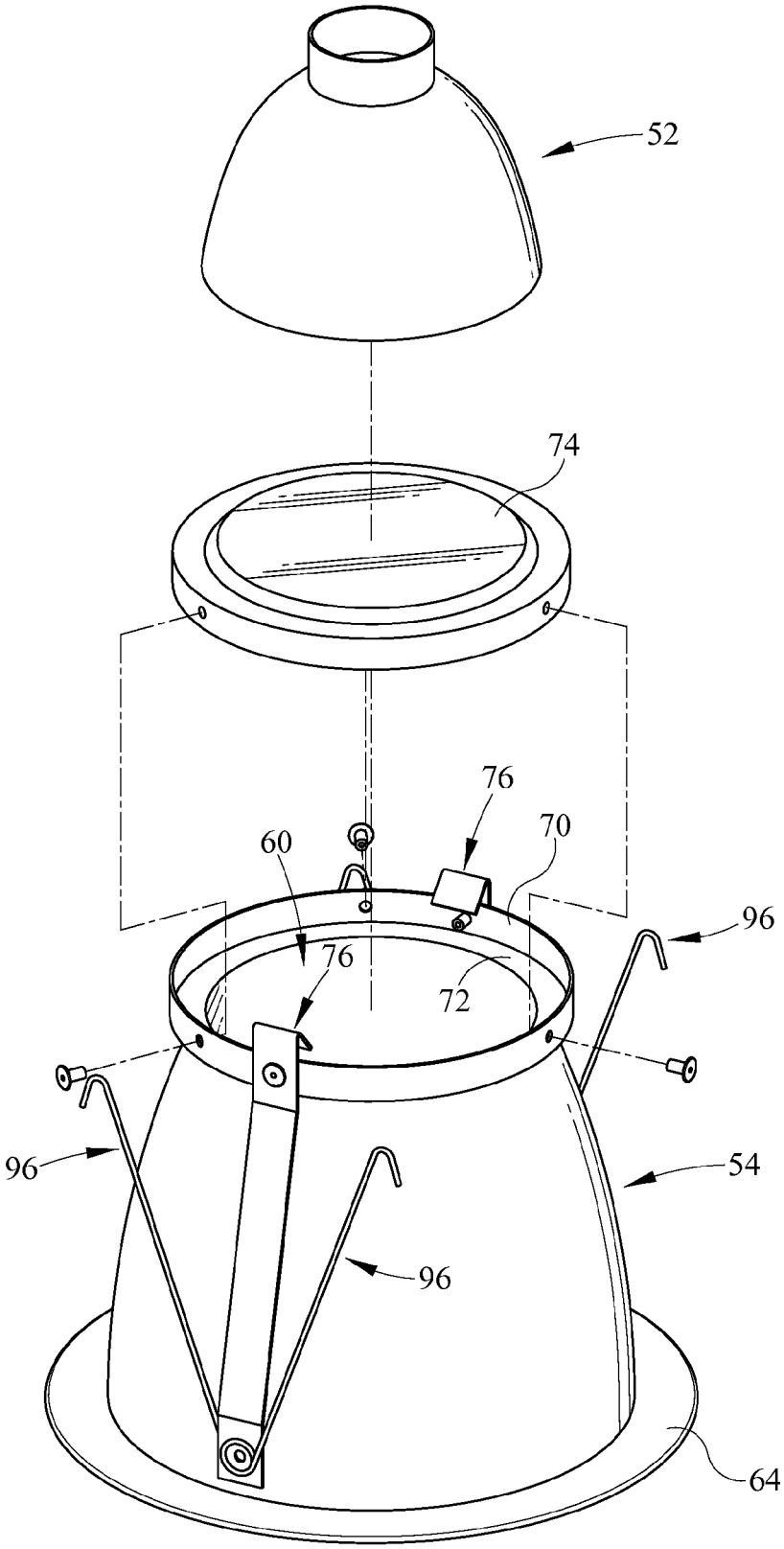
FIG. 7 is a perspective view of the multi-piece reflector assembly and diffuser.

Referring now to FIG. 7, an exploded view of the reflector assembly 50 is depicted. The upper reflector 52 is exploded from the diffuser 74, which is exploded from the lower reflector 54. Seated at the upper end of the lower reflector 54 is mounting ring 70 including the shoulder 72. The diffuser 74 includes a cartridge surrounding the lens portion. The cartridge is seated within the mounting ring 70 and on the shoulder 72. Fasteners may be utilized to extend through the mounting ring 70 into the diffuser or cartridge, in order to retain the diffuser therein. Thus, as previously mentioned, the modular design of the diffuser and lower reflector allows for easy replacement of the diffuser, by replacement of the lower reflector 54, should such change be required. Also depicted in FIG. 7 are the spring clips 76 which also help to retain the diffuser in position.

Also, as previously mentioned, the mounting ring may be positioned on the lower reflector 54, as currently shown, or may be positioned on the lower end of the upper reflector 52. The lower reflector 54 further comprises plurality of torsional and spring elements 96 which extend through a lower landings 45 (FIG. 3) of the fixture frame 14 so as to inhibit the lower reflector 54 from falling out of the fixture frame-in kit 10. This is clearly shown in FIGS. 1 and 3.

The foregoing description of structures and methods has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An LED downlight fixture, comprising:

an array of LEDs in thermal connectivity with a heatsink, said array of LEDs positioned adjacent a first aperture of a multi-piece reflector assembly;

said multi-piece reflector assembly including:

a first reflector having said first aperture disposed in an upper portion of said first reflector and an opposed larger second aperture in a lower portion of said first reflector;

a second reflector having a first aperture positioned adjacent said second aperture of said first reflector and a second aperture opposite said first aperture of said second reflector and defining a light exit passageway;

a diffuser positioned proximal to and extending across said second aperture of said first reflector and said first aperture of said second reflector.

2. The LED downlight fixture of claim 1, wherein said heatsink has a plurality of fins positioned external to said reflector assembly.

3. The LED downlight fixture of claim 1, wherein each LED of said array of LEDs is surrounded by an LED reflector.

4. The LED downlight fixture of claim 1, wherein said second reflector is attached to said first reflector.

5. The LED downlight fixture of claim 1, wherein said diffuser is engaging said first reflector and extends across said second aperture of said first reflector.

6. The LED downlight fixture of claim 5, wherein said second reflector is attached to said diffuser.

7. The LED downlight fixture of claim 1, wherein said diffuser is attached to said second reflector and extends across said first aperture of said second reflector.

8. The LED downlight fixture of claim 1, wherein a support frame is attached to said heatsink and the exterior of said second reflector.

9. The LED downlight fixture of claim 1, wherein said first aperture of said first reflector, said second aperture of said first reflector, said diffuser, and said first and second aperture of said second reflector are all vertically aligned.

10. A LED downlight fixture, comprising:

an LED array having a plurality LEDs in thermal communication with a heat sink;

a reflector assembly having a first reflector portion and a second reflector portion, said reflector assembly having:

a first reflector including an upper aperture and a lower aperture;

a second reflector including a second upper aperture and a second lower aperture;

said second upper aperture of said second reflector aligned with said lower aperture of said first reflector;

a diffuser captured between said first reflector and said second reflector and substantially aligned with said lower aperture of said first reflector and said upper aperture of said lower second reflector;

said LEDs aligned with said upper aperture of said first reflector and said heat sink extending radially above an outer surface of said first reflector.

11. The LED downlight fixture of claim 10 further comprising a non-conductive lens between said LED array and said upper aperture of said first reflector.

12. The LED downlight fixture of claim 10 further comprising a mounting ring positioned on one of said first reflector and said second reflector.

13. The LED downlight fixture of claim 12, said diffuser positioned in said mounting ring.

14. The LED downlight fixture of claim 10, said first reflector and said second reflector defining a light exit passageway.

15. The LED downlight fixture of claim 14, said diffuser positioned in said light exit passageway.

16. A LED downlight fixture, comprising:

an array of LEDs defined by a plurality of LEDs, said LEDs in thermal communication with a heat sink;

a reflector assembly having a first reflector portion and a second reflector portion, said reflector assembly defining a light exit passageway;

said first reflector having a first upper aperture and a second lower aperture;

said second reflector having a first upper aperture and a second lower aperture;

said array of LEDs positioned over said first upper aperture of said first reflector;

a diffuser connected to one of said first reflector and said second reflector and disposed within said reflector assembly and in alignment with said second lower aperture of said first reflector and said first upper aperture of said second reflector;

said heat sink having a plurality of radially extending fins, positioned above said reflector assembly.

17. The LED downlight fixture of claim 16, said LED array further comprising a circuit board.

18. The LED downlight fixture of claim 17 further comprising a lens disposed over between said LED array and said reflector assembly inhibit contact between said LED array and said reflector assembly.

19. An LED downlight fixture, comprising:

an LED array formed of a plurality of LEDs, said LED array positioned in thermal communication with a heat sink;

a reflector having an upper opening and a lower opening, said LED array disposed adjacent said upper opening;

a diffuser positioned a preselected spaced distance from said LED array; said diffuser positioned one of above a lowermost edge reflector or beneath said lowermost edge of said reflector; and, a lens disposed between said LED array and an uppermost edge of said reflector.

20. The LED downlight fixture of claim 19, said diffuser connected to a spacer element, said spacer element connected to said reflector.

21. The LED downlight fixure of claim 19, said diffuser affixed to an interior of said reflector.

* * * * *